United States Patent [19]

Yabe

[11] Patent Number: 4,821,881

[45] Date of Patent: Apr. 18, 1989

[54] FOLDUP PAPER CONTAINER

[76] Inventor: Yoshiharu Yabe, 25-banchi, 4-ban, 1-chome, Doshin, Kita-ku, Osaka-shi, Osaka-fu, Japan

[21] Appl. No.: 69,195

[22] Filed: Jul. 2, 1987

Related U.S. Application Data

[62] Division of Ser. No. 765,350, Aug. 13, 1985, Pat. No. 4,688,673.

[30] Foreign Application Priority Data

| | | | |
|---|---|---|---|
| Feb. 15, 1985 | [JP] | Japan | 60-5709 |
| Feb. 18, 1985 | [JP] | Japan | 60-21475 |
| Feb. 22, 1985 | [JP] | Japan | 60-6925 |
| Jun. 18, 1985 | [JP] | Japan | 60-25638 |
| Jun. 18, 1985 | [JP] | Japan | 60-25639 |

[51] Int. Cl.[4] ..... B65D 85/672

[52] U.S. Cl. ..... 206/387; 206/491; 229/165; 229/182

[58] Field of Search ..... 206/45.31, 45.33, 387, 206/424, 444, 491; 229/16 A, 40, 165, 182

[56] References Cited

U.S. PATENT DOCUMENTS

| | | | |
|---|---|---|---|
| 695,205 | 3/1902 | Goodnow | 229/182 |
| 1,144,746 | 6/1915 | Ziegler | 229/182 |
| 1,838,154 | 12/1931 | Raftenberg | 229/165 |
| 1,911,952 | 5/1933 | Halladay | 229/165 |
| 2,980,308 | 4/1961 | Bolding | 229/182 |
| 3,073,502 | 1/1963 | Phin | 229/16 A |
| 3,412,921 | 11/1968 | Rekow | 229/165 |
| 3,792,811 | 2/1974 | Carpenter et al. | 206/424 |
| 4,125,189 | 11/1978 | Fujimoto et al. | 206/387 |
| 4,350,247 | 9/1982 | Garrod | 206/387 |
| 4,445,634 | 5/1984 | Sato | 206/387 |
| 4,545,483 | 10/1985 | Shiba et al. | 206/387 |
| 4,688,673 | 8/1987 | Yabe | 206/491 |

*Primary Examiner*—David T. Fidei

*Attorney, Agent, or Firm*—Gifford, Groh, Sheridan, Sprinkle and Dolgorukov

[57] ABSTRACT

The disclosed invention provides a container made of paper and comprising an end wall opposite an opening, right and left side walls extending between the end wall and the opening, and upper and lower side walls extending between the end wall and the opening. Each of the side walls has a double layer construction consisting of a bend part and a foldback part bonded together. Cut edges of paper are disposed inwardly of the container away from the opening.

10 Claims, 7 Drawing Sheets

FOLDUP PAPER CONTAINER

CROSS-REFERENCE TO RELATED APPLICATIONS

This is a divisional application of Ser. No. 765,350 filed Aug. 13, 1985, now U.S. Pat. No. 4,688,673.

BACKGROUND OF THE INVENTION

This invention relates to a container for receiving a video tape, floppy disks, or varied other articles, and more particularly to a paper container folded up to define an opening for putting such articles in and out.

A conventional foldup paper container of this type is illustrated in FIG. 8 of the accompanying drawings. As seen, a sheet of paper 01 includes bend parts 01*a* to 01*i* which constitute various parts of the container when folded up. The bend parts that will define an opening when folded up will have their edges exposed to outside.

This type of known paper container has the advantage of low cost over a container formed of plastics. However, since the edges of the bend parts defining the opening are always exposed to outside, these edges tend to be contacted by hands and articles resulting in generation of paper powder or particles as the edges wear. Because of this the illustrated paper container is not suitable for video tapes which are vulnerable to paper particles. Thus such a paper container has a limited range of use.

In order to solve or alleviate the problem, these edges may be coated with a resin such as polypropylene. However, it would necessitate an apparatus for applying the resin coating to be installed in the container production line, which would increase the equipment cost and container manufacturing cost.

SUMMARY OF THE INVENTION

This invention has been made in order to restrain the generation of paper powder or particles and provide a strong container by means of rational modification effected on part of a paper sheet.

The object of the invention, therefore, is to provide a paper container formed by folding up a sheet of paper comprising foldback parts continuous with at least those bend parts which will define an opening when the sheet is folded up to form the container. The foldback parts are adapted to be folded back inwardly of the container.

According to this invention, the foldback parts continuous with at least those bend parts which will define the opening are folded back inwardly of the container during the container forming process. Therefore the foldback parts do not have their respective edges exposed to outside, whereby the edges are protected from contacts by hands and articles. Since the invention involves only partial modifications to the paper cutting process, the paper container is manufactured with a smaller number of manufacturing steps and a smaller number of machines than the case of coating the edges with a resin such as polypropylene.

Thus, the container according to this invention departs from the prior art container by the simple and inexpensive modification consisting in the foldback parts provided to be continuous with the bend parts of the paper sheet which will define the opening of the resulting container. Although the modification is simple and inexpensive, the container of this invention has the paper edges protected against wear due to sliding contacts by hands and articles thereby to minimize generation of paper powder or paper particles. Therefore, the paper container according to this invention is well suited for containing video tapes or floppy disks which are vulnerable to paper powder or particles. Moreover, the foldback parts advantageously act as reinforcements for the bend parts. This ensures a sufficient strength required of the container without substantially increasing the wall thickness of the container. Of course, the articles that can be placed in the container are not limited to video tapes and floppy disks, and the shape and size of the container may be chosen to suit the articles to be placed therein.

Other objects and advantages of this invention will be apparent from the following description.

DETAILED DESCRIPTION OF THE PREFERRED EMBODIMENTS

Figure 1:
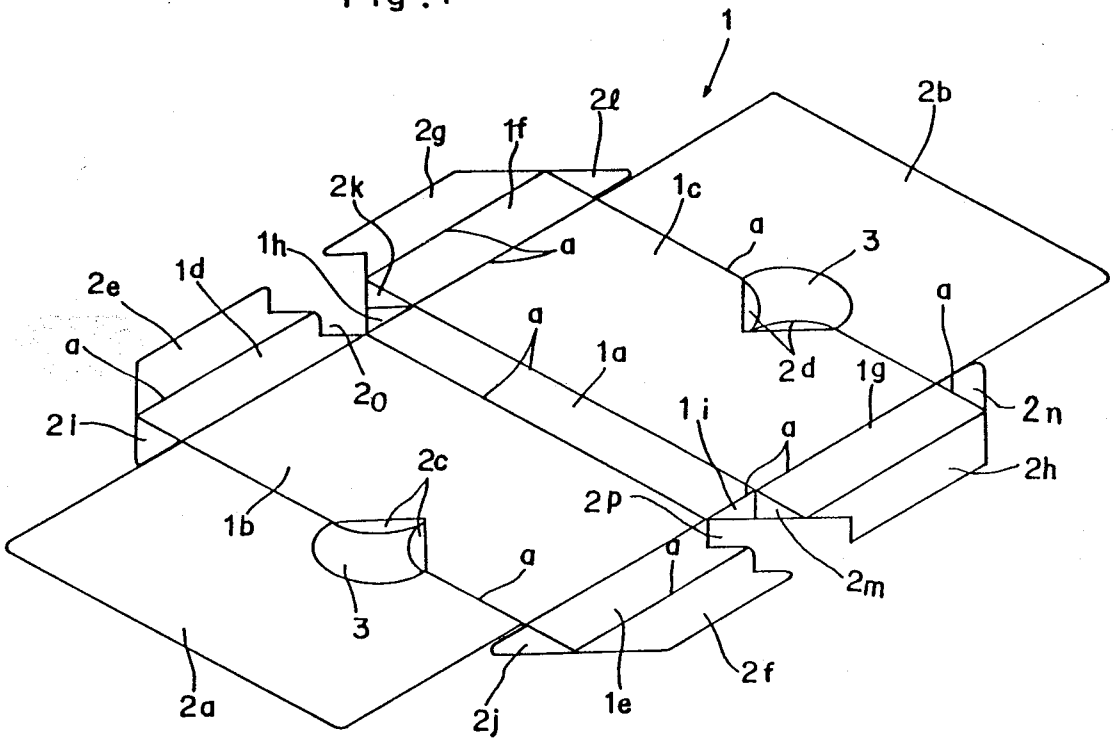
FIG. 1 is a developed perspective view of a foldup paper container according to a first embodiment of this invention,.
Figure 2:
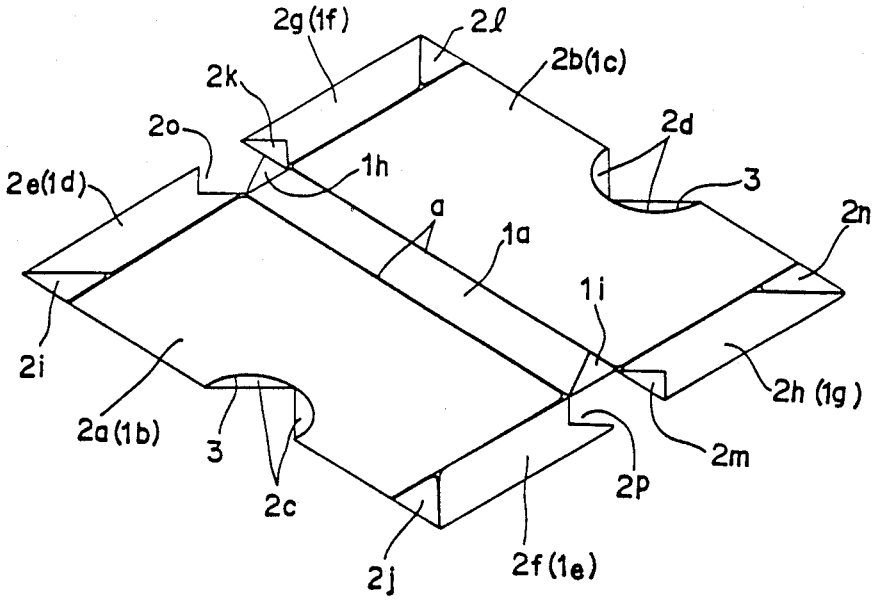
FIGS. 2 and 3 are perspective views showing a foldup process, respectively.
Figure 3:
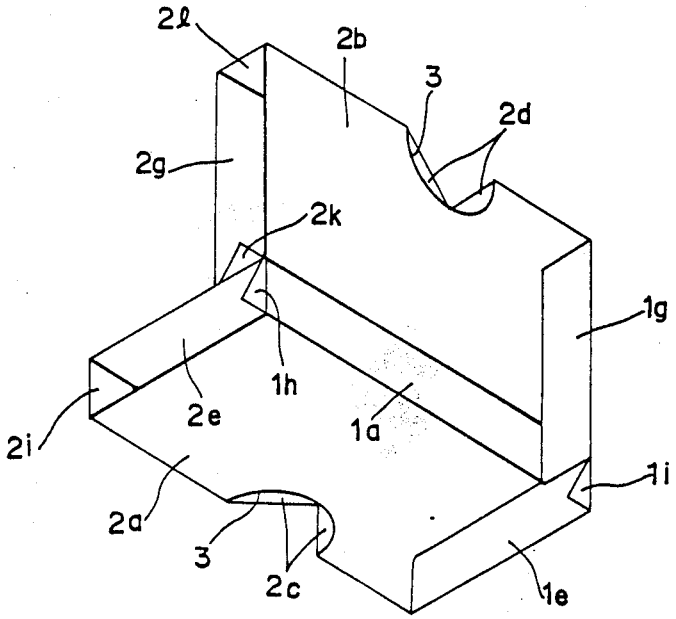
Figure 5:
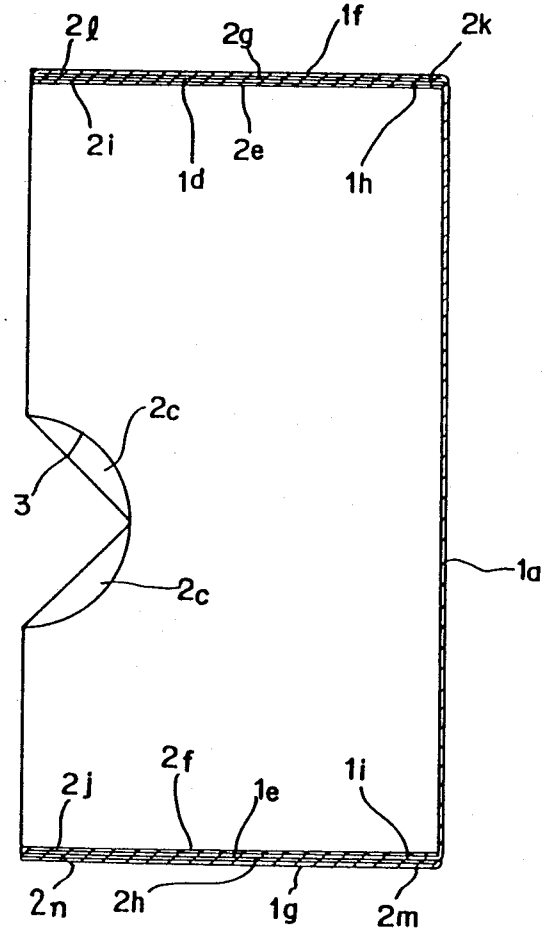
FIG. 5 is a sectional view taken on line V—V of FIG. 4.
Figure 4:
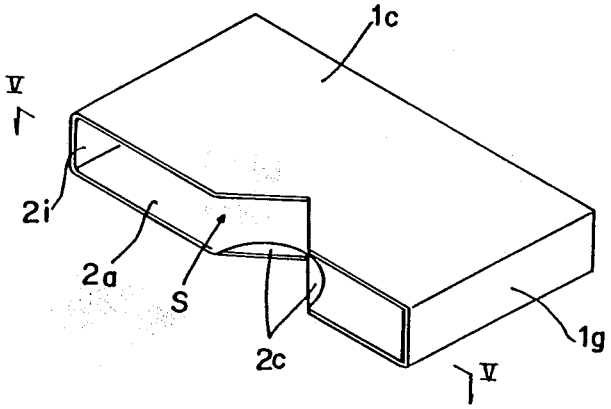
FIG. 4 is a perspective view of the container as folded up.

Several embodiments of this invention will be described hereinafter with reference to the accompanying drawings.

Referring to FIGS. 1 through 5 and FIG. 9, a sheet of paper 1 is shown which is folded up to form a box or container for a video tape which is one example of articles to be placed in the container. The container defines an opening S for putting the video tape in and out. The sheet of paper 1 comprises a rectangular bend part 1*a* which constitutes an end wall of the container, and rectangular bend parts 1*b* and 1*c* continuous with opposite long sides of the bend part 1*a* and constituting righthand and lefthand side walls of the container. The bend parts 1*b* and 1*c* constituting the side walls have bend parts 1*d* to 1*g* continuous with short sides thereof, respectively. These four bend parts 1*d* to 1*g* constitute layers of upper and lower walls of the container. The bend part 1*a* constituting the end wall has triangular foldback parts 1*h* and 1*i* continuous with short sides thereof. The triangular foldback parts 1*h* and 1*i* are adapted to overlap the upper bend parts 1*d* and 1*f* and the lower bend parts 1*e* and 1*g*, respectively.

The sheet 1 further comprises foldback parts 2a and 2b extending from those sides of the bend parts which define the opening S of the container. The foldback parts 2a and 2b are folded into the container so that cut edges thereof are located in contact with or adjacent inside faces of the bend parts 1a constituting the end wall and of the bend parts 1d to 1g constituting the upper and lower walls. A cutout 3 which is a combination of a triangular cutout and a semicircular cutout is defined at a vertically intermediate position between each of the, bend parts 1b and 1c and each of the foldback parts 2a and 2b. These cutouts 3 facilitate putting the video tape in and out. The bend parts 1b and 1c include foldback tabs 2c and 2d continuous therewith at edges of the triangular cutouts, respectively. These foldback tabs 2c and 2d are folded to contact or lie adjacent to edges of the semicircular cutouts defined in the foldback parts 2a and 2b.

Figure 9:
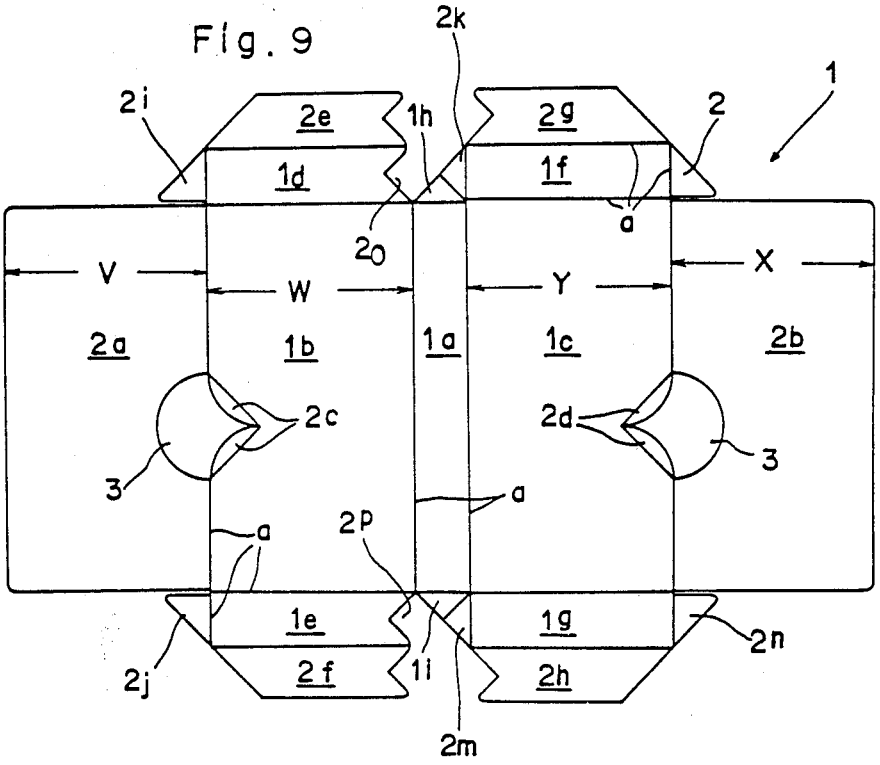
FIG. 9 is a developed plan view of the first embodiment.

As shown in FIG. 9, the foldback part 2a has a width W substantially equal to a width V of the bend part 1b, and the foldback part 2b has a width X substantially equal to a width Y of the bend part 1c. The width W is equal to the width Y.

The bend parts 1d to 1g constituting the upper and lower walls have; foldback parts 2e to 2h continuous with long sides thereof, respectively. The foldback parts 2e to 2h are folded so that edges thereof are placed in contact with or adjacent the bend parts 1b and 1c constituting the side walls of the container. The bend parts 1d to 1g constituting the upper and lower walls of the container further include triangular foldback parts 2i to 2n and triangular cutouts 2o and 2p at short sides thereof. These foldback parts 2i to 2n and cutouts 2o and 2p have edges overlapping the triangular foldback parts 1h and 1i or placed in contact with or adjacent to edges of the triangular foldback parts 1h and 1i.

When the sheet 1 is folded up to form the container, the foldback parts 2a to 2n continuous with the sides of the bend parts 1a to 1i are folded inwardly of the container. Therefore, the edges of the foldback parts are protected from sliding contacts by hands and articles. Compared for example with the case of cut edges of the sheet being exposed to outside, the construction of this invention restrains generation of paper powder or particles due to frictions caused by such sliding contacts. The described embodiment further diminishes the generation of paper powder or articles from those edges of the foldback parts 2a to 2n by placing the edges in contact with or adjacent to the other components when the sheet 1 is folded up.

Where the sheet of paper 1 has inner bend walls coated with a thermoplastic resin such as polyethylene or polypropylene in a thickness of 25–30 microns, the bend parts and foldback parts may be thermally fused together by using an existing polyethylene or polypropylene container manufacturing plant without any modification to the plant and without using an adhesive. The constituent parts may of course be bonded together by means of an adhesive.

It will be noted that reference a in the drawings denotes fold lines along which the bend parts and foldback parts may be folded in an accurate and reliable manner.

The other embodiments will be described hereinafter.

Figure 6:
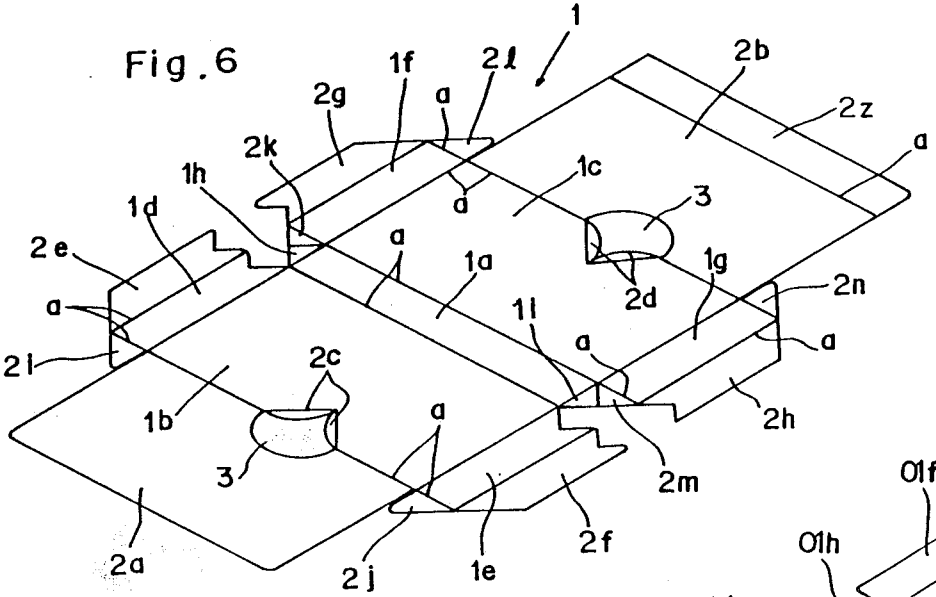
FIG. 6 is a developed perspective view of a second embodiment.
Figure 8:
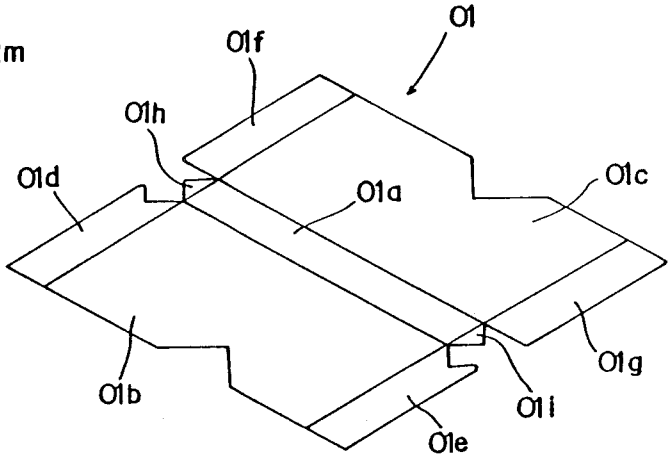
Fig. 8 (Prior Art)
FIG. 8 is a developed perspective view of a foldup paper container according to the prior art.

Referring to FIG. 6 showing a second embodiment, the sheet of paper 1 further comprises a reinforcing foldback part 22 continuous with one of the foldback parts 2a and 2b. This reinforcing foldback part 22, when the sheet 1 is folded up to form a container, overlaps an inside face of the bend part 1a constituting the end wall of the container.

Figure 7:
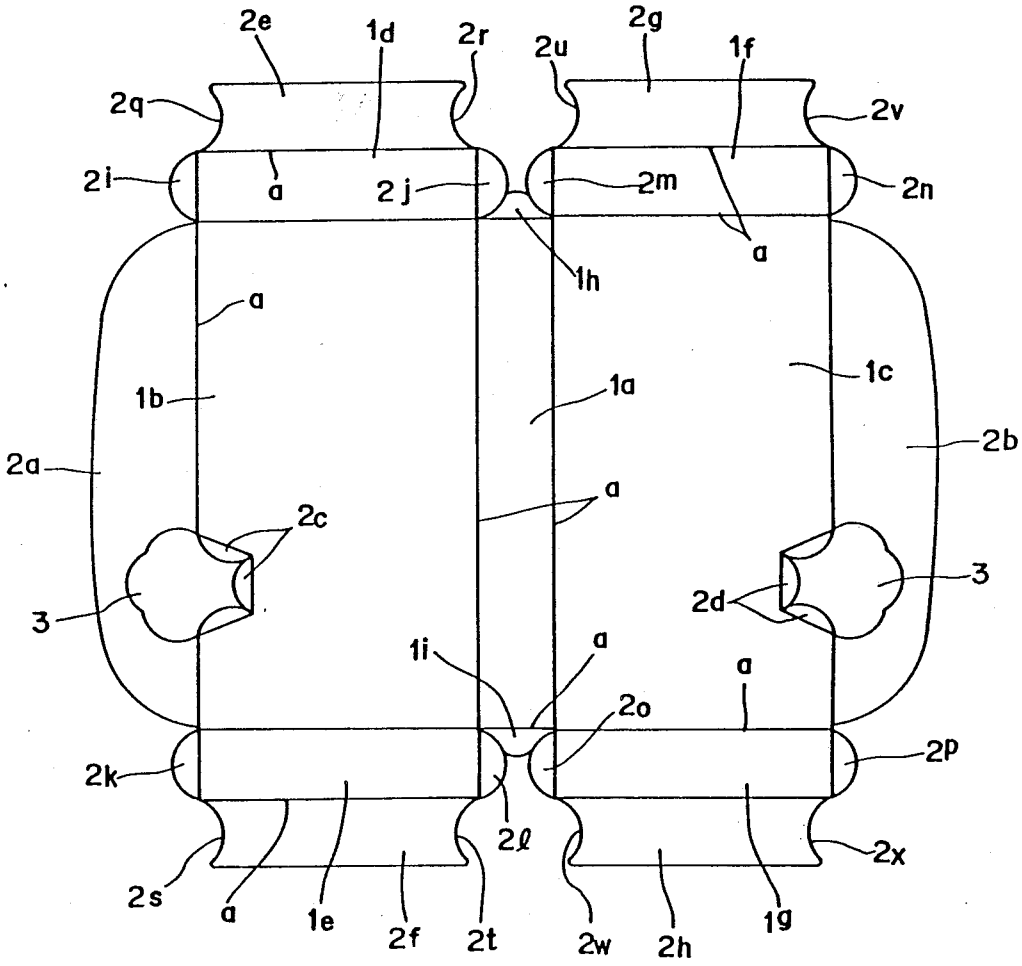
FIG. 7 is a developed plan view of a third embodiment.

Referring to FIG. 7 showing a third embodiment, the sheet of paper 1 includes foldback parts 2a and 2b each in a shape of half ellipse smaller in area than the bend part 1b or 1c constituting a side wall of the container. The bend parts 1d to 1g constituting the upper and lower walls of the container have semicircular foldback parts 2i to 2p continuous with short sides thereof. The foldback parts 2e to 2h define semicircular cutouts 2q to 2x at short sides thereof opposed to the semicircular foldback parts 2i to 2p.

Furthermore, in the third embodiment the cutouts 3 for facilitating putting in and out of the video tape each include a trapezoidal cutout having three semicircular foldback parts 2c or 2d which are placed in contact with or adjacent to edges of three semicircular cutouts defined in the foldback part 2a or 2b.

Figure 10:
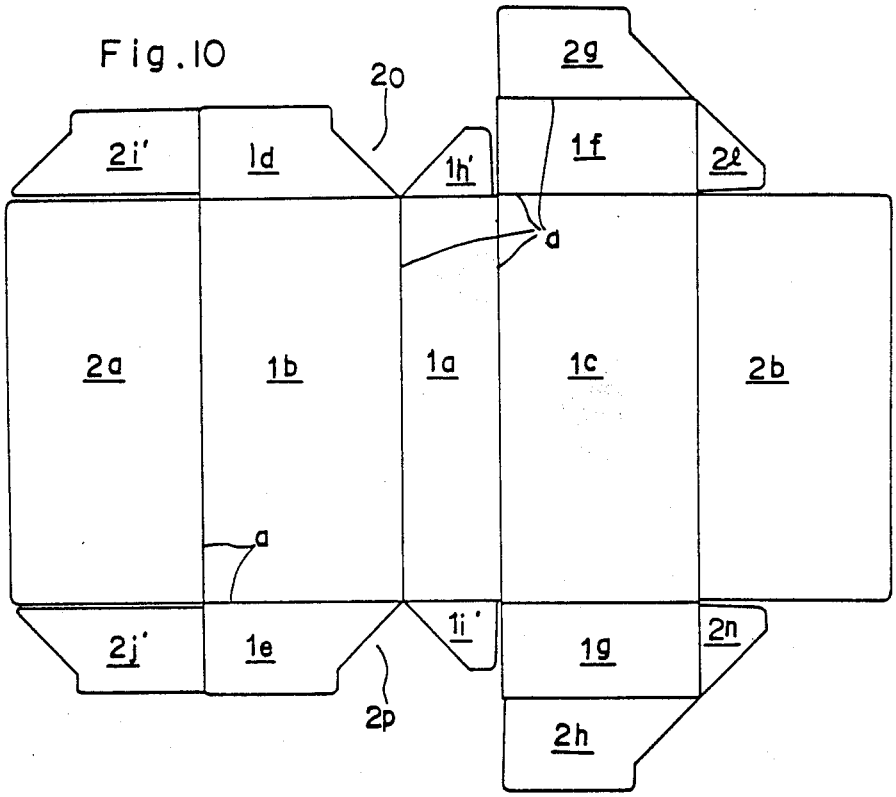
FIG. 10 is a developed plan view of a fourth embodiment.

Referring to FIG. 10 showing a fourth embodiment, the sheet includes no parts corresponding to the foldback parts 2e and 2f and the triangular foldback parts 2k and 2m in the first embodiment shown in FIG. 9. Triangular foldback parts 2i' and 2j' in this embodiment are longer than the corresponding parts 2i and 2j of FIG. 9 and substantially equal an entire width of the main foldback part 2a. Thus, the bend parts 1d to 1g are reinforced with added rigidity by the foldback parts 2i' and 2j' when the sheet is folded up to form a container. However, no cutouts are defined in the sheet.

Figure 11:
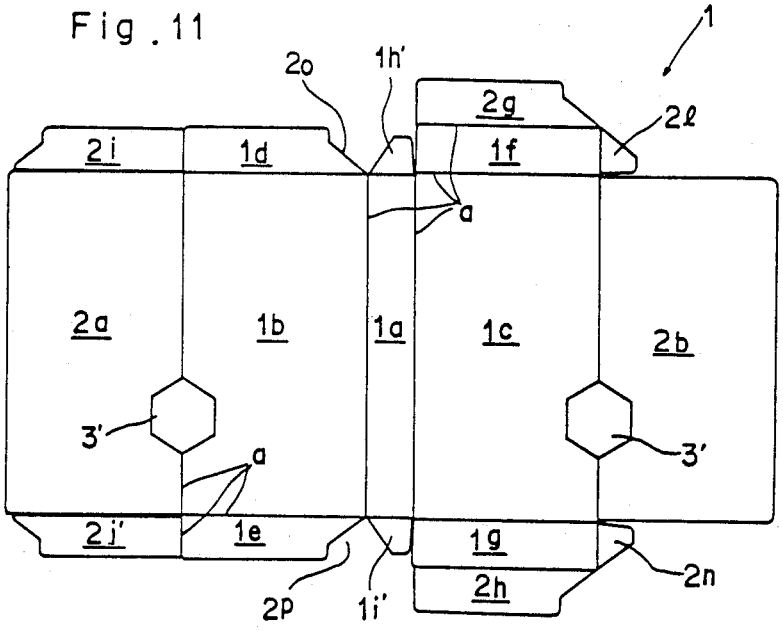
FIG. 11 is a developed plan view of a fifth embodiment.

Referring to FIG. 11, a fifth embodiment shown therein differs from the embodiment of FIG. 10 in that a hexagonal cutout 3' is defined between the bend part 1b and the foldback part 2a and a similar cutout 3' is defined between the bend part 1c and the foldback part 2b. Thus, the fifth embodiment has an advantage over the fourth embodiment in that an article such as a video tape may be put in and out with ease.

Figure 12:
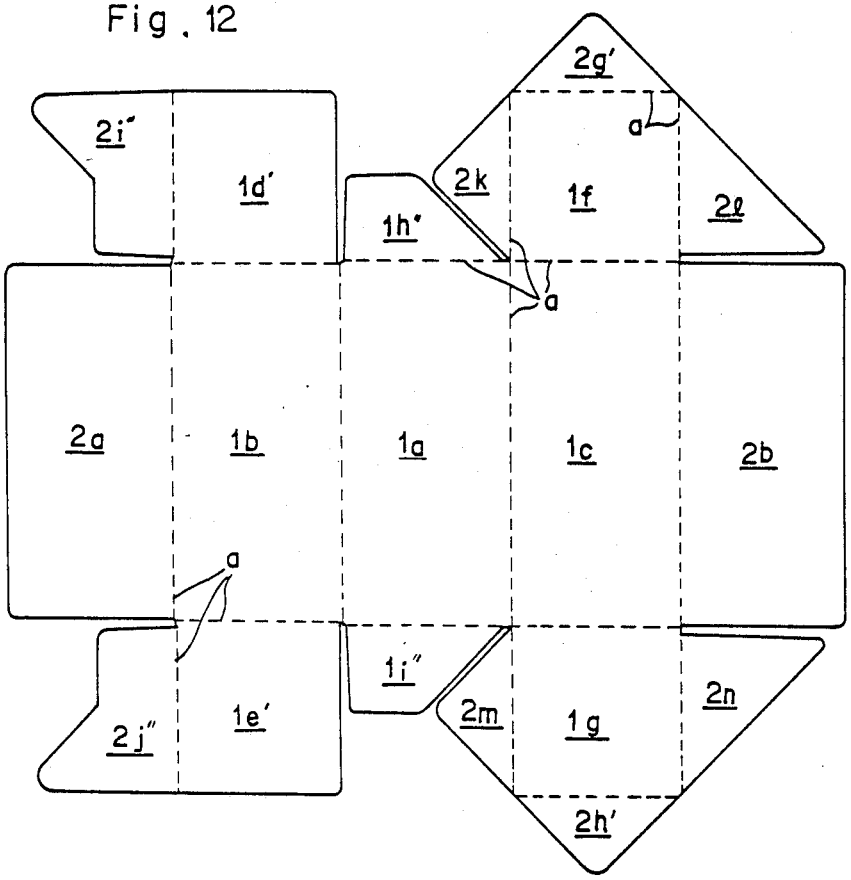
FIG. 12 is a developed plan view of a sixth embodiment.

FIG. 12 shows a sixth embodiment which comprises a paper container suited for floppy disks. This embodiment is different from the embodiment of FIG. 9 in the following respects:

(i) Foldback parts 2i'' and 2j'' are larger than the foldback parts 2i and 2j.

(ii) The foldback parts 2e and 2f are not provided.

(iii) Bend parts 1h'' and 1i'' are larger than the bend parts 1h and 1i.

(iv) The foldback parts 2g' and 2h' are triangular.

(v) The parts 1h'' and 2k are not continuous.

(vi) The cutouts 3 are not provided.

(vii) The bend parts 1d' and 1e' include no cutouts.

The sixth embodiment, however, is the same in principle as the first embodiment shown in FIG. 9.

I claim:

1. A foldup container formed from a single sheet comprising:

a first rectangular bend part having a pair of long sides and a pair of short sides;

first and second rectangular outer bend parts each having a pair of long sides, one each of which adjoins a respective one of the first bend part, and each having a pair of short sides;

first and second inner foldback parts each having a long side adjoining the other long side of said first and second outer bend parts respectively, said inner foldback parts each having a width not greater than the short sides of said outer bend parts and a length substantially equal to the long sides of said outer bend parts;

first and second upper bend parts, each having a length, a width and four sides, at least a pair of said sides being parallel, one each of which adjoins a respective one of said first and second outer bend parts along a short said thereof;

third and fourth lower bend parts, each having a length, a width and four sides, at least a pair of said sides being parallel, one each of which adjoins a respective one of said first and second outer bend parts along the other short side thereof;

at least one first and at least one second upper foldback parts, each having a side adjoining another side of said first and second upper bend parts respectively, said another side of said upper bend parts being adjacent said parallel sides, and said upper foldback parts each having a length and width not greater than the length and width of the respective upper bend part which it adjoins;

at least one third and at least one fourth lower foldback parts, each having a side adjoining another side of said third and fourth lower bend parts respectively, said another side of said lower bend parts being adjacent said parallel sides and said lower foldback parts each having a length and width not greater than the length and width of the respective lower bend part which it adjoins; and at least one of said upper and lower foldback parts being triangular;

wherein said foldup container includes a back end wall comprising said first bend part; a pair of opposed two layer sidewalls each comprising one of said inner foldback parts folded back onto a respective one of said outer bend parts along the long side on which they adjoin; a four layer upper side wall comprising said first and second upper foldback parts folded back onto said first and second upper bend parts respectively which, in turn, overlap one another; a four layer lower side wall comprising said third and fourth lower foldback parts folded back onto said third and fourth lower bend parts respectively which, in turn, overlap one another; and an opening opposite said back end wall defined by the folded edges of said two layer side walls and said upper and lower side walls.

2. A foldup container formed from a single sheet comprising:

a first rectangular bend part having a pair of long sides and a pair of short sides;

first and second rectangular outer bend parts each having a pair of long sides, one each of which adjoins a respective one of the long sides of the first bend part, and each having a pair of short sides;

first and second inner foldback parts each having a long side adjoining the other long side of said first and second outer bend parts respectively, said inner foldback parts each having a width not greater than the short sides of said outer bend parts and a length substantially equal to the long sides of said outer bend parts;

first and second upper bend parts, each having a length, a width and four sides, at least a pair of said sides being parallel, one each of which adjoins a respective one of said first and second outer bend parts along a short side thereof;

third and fourth lower bend parts, each having a length, a width and four sides, at least a pair of said sides being parallel, one each of which adjoins a respective one of said first and second outer bend parts along the other short side thereof;

at least one first and at least one second upper foldback parts, each having a side adjoining another side of said first and second upper bend parts respectively, said another side of said upper bend parts being adjacent said parallel sides, and said upper foldback parts each having a length and width not greater than the length and width of the respective upper bend part which it adjoins;

at least one third and at least one fourth lower foldback parts, each having a side adjoining another side of said third and fourth lower bend parts respectively, said another side of said lower bend parts being adjacent said parallel sides and said lower foldback parts each having a length and width not greater than the length and width of the respective lower bend part which it adjoins;

wherein said foldup container includes a back end wall comprising said first bend part; a pair of opposed two layer sidewalls each comprising one of said inner foldback parts folded back onto a respective one of said outer bend parts along the long side on which they adjoin; a four layer upper side wall comprising said first and second upper foldback parts folded back onto said first and second upper bend parts respectively which, in turn, overlap one another; a four layer lower side wall comprising said third and fourth lower foldback parts folded back onto said third and fourth lower bend parts respectively which, in turn, overlap one another; and an opening opposite said back end wall defined by the folded edges of said two layer side walls and said upper and lower side walls;

said first rectangular bend part further comprising two tabs disposed along the short sides thereof, and wherein said first upper foldback part and said third lower foldback part have notches corresponding in shape to said tabs so that said back end wall is joined to said upper and lower sidewalls by said tabs and said first upper and third lower foldback parts complement said tabs to form one complete layer of said upper and lower side walls, respectively; and said second upper foldback part and said fourth lower foldback part are each triangular.

3. The container as defined in claim 1 wherein said first rectangular bend part further comprises two tabs disposed along the short sides thereof, and wherein said first upper foldback part and said third lower foldback part have notches corresponding in shape to said tabs so that said back end wall is joined to said upper and lower sidewalls by said tabs and said first upper and third lower foldback parts complement said tabs to form one complete layer of said upper and lower side walls, respectively.

4. The container as defined in claim 2 wherein said second upper and said fourth lower triangular foldback parts each have a base corresponding to a diagonal of said upper and lower bend parts and not adjoined thereto, so that, when folded back onto said upper and lower bend parts, said second upper and said fourth lower foldback parts overlap the area of said bend parts to one side of the diagonal.

5. The container as defined in claim 4 and comprising at least one additional foldback part for each of said second upper and said fourth lower bend parts, adjoined to another of said four sides and dimensioned to overlap the area of said second upper and said fourth lower bend parts to the other side of the diagonal, so that said additional foldback parts complement said second upper and said fourth lower foldback parts to form another complete layer of said upper and lower sidewalls, respectively.

6. The container as defined in claim 5 wherein said at least one additional foldback part comprises two additional foldback tabs, one being adjoined to the remaining parallel side and the other being adjoined to the remaining adjacent side of each of said second upper and said fourth lower bend parts, so that the additional tabs combine to overlap the area of said bend parts to the other side of the diagonal.

7. The container as defined in claim 6 wherein said upper and lower bend parts are substantially square, whereby each additional foldback tab overlaps $\frac{1}{2}$ of the area to the other side of the diagonal.

8. The container as defined in claim 1 wherein said upper and lower bend parts are substantially rectangular.

9. The container as defined in claim 8 wherein said upper and lower bend parts are substantially square.

10. The container as defined in claim 1 wherein said first and second inner foldback parts each are rectangular and dimensioned substantially to overlap said first and second outer bend parts, respectively.

* * * * *